US005636448A

United States Patent [19]

Skaugen et al.

[11] Patent Number: 5,636,448

[45] Date of Patent: Jun. 10, 1997

[54] WEB DRYING APPARATUS

[75] Inventors: Borgeir Skaugen; Gregory L. Wedel, both of Beloit, Wis.

[73] Assignee: Beloit Technologies, Inc., Wilmington, Del.

[21] Appl. No.: 631,576

[22] Filed: Apr. 12, 1996

Related U.S. Application Data

[63] Continuation of Ser. No. 100,735, Aug. 2, 1993, Pat. No. 5,507,104, which is a continuation-in-part of Ser. No. 530, 386, May 30, 1990, Pat. No. 5,279,049, which is a continuation of Ser. No. 201,705, Jun. 2, 1988, abandoned, which is a continuation-in-part of Ser. No. 14,569, Feb. 13, 1987, Pat. No. 4,934,067, said Ser. No. 100,735, is a continuation-in-part of Ser. No. 867,722, Apr. 9, 1992, Pat. No. 5,249,372, which is a continuation of Ser. No. 167,672, Feb. 11, 1988, abandoned, which is a continuation-in-part of Ser. No. 14,569.

[51] Int. Cl.[6] ..... D06F 58/00

[52] U.S. Cl. ..... 34/117; 34/120

[58] Field of Search ..... 34/114, 115, 116, 34/117, 120, 122, 123

[56] References Cited

U.S. PATENT DOCUMENTS

| | | | |
|---|---|---|---|
| D. 320,105 | 9/1991 | Skaugen et al. | D34/28 |
| D. 321,269 | 10/1991 | Skaugen et al. | D32/1 |
| D. 333,710 | 3/1993 | Skaugen et al. | D32/1 |
| 409,615 | 8/1889 | Palmer . | |
| 1,402,451 | 1/1922 | Shellington . | |
| 1,656,853 | 1/1928 | Bean . | |
| 2,224,803 | 12/1940 | Standley | 34/48 |
| 2,281,340 | 4/1942 | Thiele et al. | 91/55 |
| 2,537,129 | 1/1951 | Goodwillie | 92/49 |
| 2,714,342 | 8/1955 | Beachler | 92/53 |
| 2,755,711 | 7/1956 | Moore | 92/74 |
| 2,959,222 | 11/1960 | Hornbostel | 162/360 |
| 3,079,699 | 3/1963 | Fry, Jr. | 34/13 |
| 3,110,612 | 11/1963 | Gottwald et al. | 117/64 |
| 3,250,019 | 5/1966 | Beachler | 34/117 |

(List continued on next page.)

FOREIGN PATENT DOCUMENTS

| | | |
|---|---|---|
| 0 254 666 | 1/1988 | European Pat. Off. . |
| 0 334 899 B1 | 12/1991 | European Pat. Off. . |

(List continued on next page.)

OTHER PUBLICATIONS

*Tappi Journal*, Sep. 1987, pp. 65–69, "Advances in Dryer Section Runnability" by G.L. Wedel and S. Palazzolo.

*Paper*, Jul. 1987, pp. 27–28, "Examining Runnability in the Dryer Section" by I. Binns.

(List continued on next page.)

*Primary Examiner*—Henry A. Bennett
*Assistant Examiner*—Dinnatia Doster
*Attorney, Agent, or Firm*—McAndrews, Held & Malloy, Ltd.

[57] ABSTRACT

A paper machine comprising a single tier drying section including at least two dryer groups is disclosed. In one group, the axes of rotation of at least two consecutive drying cylinders lie substantially in a plane, and the axes of rotation of the vacuum rolls are disposed below the plane of dryer cylinders. In the next group, the axes of rotation of at least two consecutive drying cylinders lie substantially in a further plane which is non-coplanar with the plane defined by the dryers of the first dryer group. The vacuum rolls of the second dryer group have their axes of rotation disposed above the further plane. The dryer transfer which transfers the web from one dryer group to the next one includes a joint run of the felts of the respective dryer sections and a vacuum roll at the downstream end of the joint run. The joint run receives the web between the felts when the web passes through the joint run. The vacuum roll is disposed at the downstream end of the joint run for positively maintaining the web in close conformity with the receiving felt when the felts diverge downstream from the joint run. The felts are free from restraining devices as they pass through the joint run. A method for drying a web employing the disclosed apparatus is also disclosed.

1 Claim, 10 Drawing Sheets

U.S. PATENT DOCUMENTS

| | | | |
|---|---|---|---|
| 3,263,344 | 8/1966 | Stickle | 34/116 |
| 3,314,162 | 4/1967 | Haywood | 34/111 |
| 3,395,073 | 7/1968 | Davis, Sr. | 162/369 |
| 3,445,938 | 5/1969 | Clark | 34/116 |
| 3,503,139 | 3/1970 | Mahoney | 34/111 |
| 3,723,169 | 3/1973 | Guastella et al. | 117/111 |
| 3,808,090 | 4/1974 | Logan et al. | 162/23 |
| 3,816,941 | 6/1974 | Holik et al. | 34/116 |
| 3,861,997 | 1/1975 | Ely | 162/360 |
| 3,868,780 | 3/1975 | Soininen et al. | 34/116 |
| 3,874,997 | 4/1975 | Kankaanpää | 162/290 |
| 3,891,501 | 6/1975 | Oka et al. | 162/290 |
| 3,948,449 | 4/1976 | Logan et al. | 241/41 |
| 3,981,084 | 9/1976 | Sobota | 34/123 |
| 4,000,035 | 12/1976 | Schiel et al. | 162/290 |
| 4,075,056 | 2/1978 | Ely et al. | 162/305 |
| 4,086,131 | 4/1978 | Rempel et al. | 162/203 |
| 4,115,189 | 9/1978 | Cyrenne | 162/305 |
| 4,179,330 | 12/1979 | Page | 162/113 |
| 4,183,148 | 1/1980 | Koski et al. | 34/23 |
| 4,202,113 | 5/1980 | Kankaanpää | 34/23 |
| 4,236,962 | 12/1980 | Kankaanpää | 162/204 |
| 4,257,844 | 3/1981 | Schmitt et al. | 162/305 |
| 4,335,603 | 6/1982 | Locke | 73/159 |
| 4,359,827 | 11/1982 | Thomas | 34/16 |
| 4,359,828 | 11/1982 | Thomas | 34/114 |
| 4,361,466 | 11/1982 | Wong et al. | 162/207 |
| 4,406,739 | 9/1983 | Kankaanpää | 162/203 |
| 4,441,263 | 4/1984 | Vedenpää | 34/115 |
| 4,444,361 | 4/1984 | Nuttall | 242/65 |
| 4,481,723 | 11/1984 | Vedenpää | 34/114 |
| 4,483,083 | 11/1984 | Chance | 34/113 |
| 4,502,231 | 3/1985 | Fissmann et al. | 34/114 |
| 4,510,698 | 4/1985 | Ely | 34/117 |
| 4,517,054 | 5/1985 | Hujala et al. | 162/301 |
| 4,523,978 | 6/1985 | Pullinen | 162/300 |
| 4,526,655 | 7/1985 | Karvinen et al. | 162/360.1 |
| 4,539,762 | 9/1985 | Eskelinen et al. | 34/114 |
| 4,543,160 | 9/1985 | Kerttula et al. | 162/193 |
| 4,551,203 | 11/1985 | Eskelinen | 162/202 |
| 4,556,451 | 12/1985 | Ely | 162/205 |
| 4,566,944 | 1/1986 | Mauranen et al. | 162/286 |
| 4,566,946 | 1/1986 | Koponen et al. | 162/359 |
| 4,584,058 | 4/1986 | Lehtinen et al. | 162/199 |
| 4,602,439 | 7/1986 | Eskelinen et al. | 34/23 |
| 4,608,124 | 8/1986 | Mauranen et al. | 162/193 |
| 4,609,435 | 9/1986 | Tissari | 162/203 |
| 4,614,566 | 9/1986 | Koponen et al. | 162/301 |
| 4,625,430 | 12/1986 | Aula et al. | 34/13 |
| 4,625,434 | 12/1986 | Karlsson et al. | 34/114 |
| 4,654,981 | 4/1987 | Grebe et al. | 34/114 |
| 4,669,198 | 6/1987 | Wedel | 34/23 |
| 4,677,762 | 7/1987 | Futcher | 34/114 |
| 4,684,443 | 8/1987 | Kerttula et al. | 162/255 |
| 4,686,778 | 8/1987 | Kotitschke et al. | 34/117 |
| 4,693,784 | 9/1987 | Aula et al. | 162/202 |
| 4,716,660 | 1/1988 | Thiele | 34/114 |
| 4,728,396 | 3/1988 | Alheid | 162/193 |
| 4,738,035 | 4/1988 | Grebe et al. | 34/114 |
| 4,744,156 | 5/1988 | Futcher | 34/114 |
| 4,744,866 | 5/1988 | Koponen et al. | 162/203 |
| 4,758,310 | 7/1988 | Miller | 162/359 |
| 4,768,294 | 9/1988 | Weideburg | 34/116 |
| 4,792,381 | 12/1988 | Pajula | 162/360.1 |
| 4,793,899 | 12/1988 | Skaugen | 162/381 |
| 4,807,371 | 2/1989 | Wedel | 34/117 |
| 4,815,220 | 3/1989 | Wedel | 34/120 |
| 4,835,881 | 6/1989 | Welsby | 34/117 |
| 4,844,442 | 7/1989 | Gämmerler | 271/225 |
| 4,850,121 | 7/1989 | Ely | 34/116 |
| 4,874,470 | 10/1989 | Skaugen | 162/360.1 |
| 4,875,976 | 10/1989 | Wedel | 162/306 |
| 4,876,803 | 10/1989 | Wedel | 34/117 |
| 4,882,854 | 11/1989 | Wedel et al. | 34/115 |
| 4,888,883 | 12/1989 | Kerttula | 34/116 |
| 4,889,598 | 12/1989 | Niskanen | 162/199 |
| 4,905,379 | 3/1990 | Wedel | 34/16 |
| 4,909,905 | 3/1990 | Ilmarinen et al. | 162/360.1 |
| 4,917,766 | 4/1990 | Koivuranta et al. | 162/301 |
| 4,918,836 | 4/1990 | Wedel | 34/23 |
| 4,919,760 | 4/1990 | Kerttula | 162/300 |
| 4,919,762 | 4/1990 | Laapotti et al. | 162/360.1 |
| 4,923,568 | 5/1990 | Hietikko et al. | 162/301 |
| 4,931,143 | 6/1990 | Karvinen et al. | 162/360.1 |
| 4,934,067 | 6/1990 | Wedel | 34/41 |
| 4,943,351 | 7/1990 | Wedel | 162/205 |
| 4,945,655 | 8/1990 | Wedel | 34/23 |
| 4,967,489 | 11/1990 | Autio | 34/114 |
| 4,970,805 | 11/1990 | Wedel | 34/115 |
| 4,972,608 | 11/1990 | Ilvespää | 34/115 |
| 4,976,821 | 12/1990 | Laapotti | 162/360.1 |
| 4,980,979 | 1/1991 | Wedel | 34/23 |
| 4,982,513 | 1/1991 | Loser et al. | 34/116 |
| 4,986,009 | 1/1991 | Haessner et al. | 34/23 |
| 5,020,242 | 6/1991 | Mayer et al. | 34/115 |
| 5,031,338 | 7/1991 | Wedel | 34/115 |
| 5,033,207 | 7/1991 | Sturm et al. | 34/115 |
| 5,037,509 | 8/1991 | Wedel | 162/286 |
| 5,044,095 | 9/1991 | Eivola | 34/117 |
| 5,046,266 | 9/1991 | Autio | 34/120 |
| 5,050,317 | 9/1991 | Kade et al. | 34/117 |
| 5,062,216 | 11/1991 | Hannigan | 34/16 |
| 5,063,689 | 11/1991 | Sollinger | 34/115 |
| 5,064,503 | 11/1991 | Tavi | 162/359 |
| 5,065,529 | 11/1991 | Skaugen et al. | 34/117 |
| 5,068,980 | 12/1991 | Müller | 34/117 |
| 5,074,966 | 12/1991 | Koivuranta | 162/301 |
| 5,084,139 | 1/1992 | Autio | 162/360.1 |
| 5,087,325 | 2/1992 | Page | 162/193 |
| 5,101,577 | 4/1992 | Wedel | 34/114 |
| 5,105,561 | 4/1992 | Wulz | 34/117 |
| 5,115,581 | 5/1992 | Viitanen | 34/115 |
| 5,144,758 | 9/1992 | Skaugen et al. | 34/117 |
| 5,146,696 | 9/1992 | Mayer et al. | 34/117 |
| 5,151,156 | 9/1992 | Schiel | 162/368 |
| 5,152,078 | 10/1992 | Wedel | 34/115 |
| 5,169,501 | 12/1992 | Meinecke | 162/359.1 |
| 5,175,945 | 1/1993 | Skaugen et al. | 34/117 |
| 5,177,880 | 1/1993 | Preisetanz et al. | 34/117 |
| 5,184,408 | 2/1993 | Kotitschke et al. | 34/117 |
| 5,185,063 | 2/1993 | Aula et al. | 162/193 |

FOREIGN PATENT DOCUMENTS

| | | |
|---|---|---|
| 1370915 | 7/1964 | France . |
| 1572200 | 6/1969 | France . |
| 2 346 491 | 10/1977 | France . |
| 2 386 638 | 11/1978 | France . |
| 266060 | 10/1913 | Germany . |
| 1 901 450 | 6/1970 | Germany . |
| 2 212 209 | 9/1973 | Germany . |
| 2 355 397 | 6/1974 | Germany . |
| 28 13 933 | 10/1978 | Germany . |
| 31 46 936 | 6/1982 | Germany . |
| 32 36 576 | 4/1984 | Germany . |
| 33 44 216 | 6/1985 | Germany . |
| 35 20 070 | 12/1985 | Germany . |
| 35 38 623 | 5/1986 | Germany . |
| 38 28 743 | 3/1989 | Germany . |
| 9001209 U | 5/1990 | Germany . |
| 63-105197 | 5/1988 | Japan . |
| 36-89996 | 6/1988 | Japan . |
| 305229 | 6/1971 | U.S.S.R. . |

| | | |
|---|---|---|
| 1121341 A | 10/1984 | U.S.S.R. . |
| 733242 | 7/1955 | United Kingdom . |
| 775206 | 5/1957 | United Kingdom . |
| 919932 | 2/1963 | United Kingdom . |
| 2173832 | 10/1986 | United Kingdom . |
| WO81/01428 | 5/1981 | WIPO . |
| WO82/02937 | 9/1982 | WIPO . |
| WO83/00514 | 2/1983 | WIPO . |
| WO88/04206 | 6/1988 | WIPO . |
| WO88/06204 | 8/1988 | WIPO . |
| WO88/06205 | 8/1988 | WIPO . |
| WO88/08898 | 11/1988 | WIPO . |
| WO90/04065 | 4/1990 | WIPO . |
| WO90/12150 | 10/1990 | WIPO . |
| WO90/12151 | 10/1990 | WIPO . |

OTHER PUBLICATIONS

*Consolidated News,* Aug.–Oct. 1991, vol. 29, No. 4, pp. 8–9, "No. 16 takes shape".

Heimback–Seminar Jun. 10, 1989, "Neue Elemente Bei Der Papiertrocknung", by J. Fischer (J.M. Voith GmbH).

Hauser "Analysis of Runnability Problems In The Paper Machine and Modern Concepts of Paper Drying. [Manuscript]", [Periodical? Date?].

M. Kämmerer, "Filzführung ohne freie Papierzüge im der Trockenpartie—Erfahrungen mit Slalom Wochenblatt for Papierfabrikation 2 (1978)" pp. 63–65 (German no translation).

Sheet Flutter & Windage, Tappi Press, 1991.

*Die Papier Fabrikation und ihre Maschinen,* (1938), published in Germany, vol. 11, pp. 155–157, Drawing Sheet No. 503, Drawing Sheet No. 23, and Drawing entitled "Paper Machine V—2100 trimmed paper width for Mr. T.W. Branders—Berg–Gladbach—1900 (with English translation)".

J. Linderot, "Zehn Jahre Erfahrung mit Geschlossener Bahnfuhrun in der Trockenpartie," *Wochenblatt Fur Papierfabrikation,* Aug. 1986, vol. 14, No. 16, pp.623–629 (with translation).

"Pulp and Paper Dictionary" by John R. Lavigne, 1986.

Ser. No. 07/167,672, Skaugen et al., filing date. Feb. 11, 1988.

Ser. No. 07/201,705; Skaugen et al. filing date Jun. 2, 1988.

Ser. No. 07/530,386, Skaugen et al., filing date May 30, 1990.

Ser. No. 07/606,654, Skaugen et al. filing date Oct. 31, 1990.

Ser. No. 07/797,597, Skaugen et al., filing date Nov. 25, 1990.

Ser. No. 08/064,840, Skaugen et al., filing date Mar. 2, 1992.

Ser. No. 07/867,722, Skaugen et al., filing date Mar. 9, 1993.

WEB DRYING APPARATUS

CROSS-REFERENCE TO RELATED SPECIFICATIONS

This is a continuation of Set. No. 08/100,735, filed Aug. 2, 1993, now U.S. Pat. No. 5,507,104, which is a continuation-in-part of Ser. No. 07/530,386, filed May 30, 1990, now U.S. Pat. No. 5,279,049, which is a continuation of Ser. No. 07/201,705 filed on Jun. 2, 1988, now abandoned, which is a continuation in part of U.S. Ser. No. 014,569 filed Feb. 13, 1987, now U.S. Pat. No. 4,934,067. Ser. No. 08/100,735 is also a continuation in part of U.S. Ser. No. 867,722, filed Apr. 9, 1992, now U.S. Pat. No. 5,249, 372, which is a continuation of U.S. Ser. No. 07/167,672, filed Feb. 11, 1988, now abandoned, which is a continuation-in-part of U.S. Ser. No. 014,569. All the disclosure of each prior application identified above is incorporated herein by reference.

The following additional patent applications and patents are commonly owned with the present specification and concern similar subject matter:

| U.S. Ser. No. | Date Filed | Patent Number or other Status |
|---|---|---|
| 07/014,569 | February 13, 1987 | 4,934,067 |
| 07/126,547 | November 30, 1987 | 4,807,371 |
| 07/201,705 | June 2, 1988 | abandoned |
| 07/223,186 | July 22, 1988 | 4,876,803 |
| 07/230,627 | August 10, 1988 | 4,945,655 |
| 07/235,394 | August 23, 1988 | 4,918,836 |
| 07/243,742 | September 9, 1988 | 4,980,979 |
| 07/244,774 | September 14, 1988 | 4,905,379 |
| 07/417,978 | October 5, 1989 | 4,970,805 |
| 07/429,730 | October 26, 1989 | 5,175,945 |
| 07/431,961 | November 3, 1989 | 5,101,577 |
| 07/485,681 | February 27, 1990 | 5,065,529 |
| 07/530,386 | May 30, 1990 | pending |
| 07/540,075 | June 19, 1990 | D-321,269 |
| 07/540,420 | June 19, 1990 | D-320,105 |
| 07/606,654 | October 31, 1990 | pending |
| 07/612,284 | November 9, 1990 | 5,031,338 |
| 07/660,466 | March 18, 1991 | 5,152,078 |
| 07/784,811 | October 29, 1991 | D-333,710 |
| 07/792,108 | November 14, 1991 | 5,144,758 |
| 07/797,597 | November 25, 1991 | pending |
| 07/844,143 | March 2, 1992 | pending |
| 08/064,840 | May 19, 1993 | pending |

All the disclosures of the patent applications and patents mentioned above as a related or priority application are hereby incorporated herein by reference.

BACKGROUND OF THE INVENTION

This invention relates to a papermaking machine including a drying apparatus for drying a web of paper emerging from its press section. More particularly, this invention relates to an apparatus for drying a web in which the web is transferred between dryer groups, thereby permitting threading of the web without the assistance of threading ropes and the drying of both sides of the web while restraining the web by and against felts.

The classic paper dryer consists entirely of two or more double-felted double tier dryer groups. (Each dryer group is the group of dryer cylinders of a single-felted dryer engaging a single felt or the group of dryer cylinders of a double-felted dryer group engaging a pair of upper and lower dryer felts; a typical dryer or dryer section has several dryer groups.) A series of two double-felted double tier dryer groups is shown in U.S. Pat. No. 3,263,344, issued to Stickler in 1966, in FIG. 2. In each double-felted, double-tier dryer group of Stickler, there are two horizontal rows or "tiers" of dryers, one tier (dryers 16*a* and 16*b*) above the other tier (dryers 13*a*, 13*b*, and 13*c*). The web is held against one dryer (13*a*) of the lower tier, then is transferred to a dryer (16*a*) of the upper tier, then progresses to the next dryer (13*b*) of the lower tier, then goes to the next dryer (16*b*) of the upper tier, and so forth.

This type of dryer group is called a "double-felted" group because it has two felts. The upper felt wraps around the upper part of each dryer in the upper tier, and the lower felt wraps around the lower part of each dryer in the lower tier. When the web is between the top felt and a top dryer, the bottom of the web is against the dryer. When the web is between the bottom felt and a bottom dryer, the top side of the web is against the dryer. The web is thus alternately heated on its top and bottom sides as it passes over dryers of the lower and upper tiers.

As the web leaves a lower dryer to go to the next upper dryer, the felt and the lower dryer surface separate so the web can transfer to the top dryer. As the web is led away from both the lower dryer and the lower felt, it is not touching anything on either side as it follows a long path from one dryer to the other. Such an unsupported length of the web is called an open draw. When the web reaches the next upper dryer, the upper felt and the dryer surface come together, with the web between them, to bring the web into contact with the next upper dryer. Essentially the same procedure is followed to transfer the web from an upper dryer to a lower dryer.

In a double-felted double tier dryer, each transfer from one dryer to the next within a dryer group, and/or from one dryer group to the next, has required the introduction of an extended open draw, typically more than several feet (about a meter) long and at least about 16 inches (over 400 mm) long.

The faster a paper machine can be run without creating runability problems, the more efficient the machine becomes. ("Runability" is conventionally defined as the degree to which a web can be established and maintained on the machine without breaking. One measure of runability is the frequency of web breaks.) When the speed of a conventional papermaking machine is increased, however, a serious flutter problem develops in the dryer: the paper web or sheet flutters undesirably in some or all of its open draws as the sheet progresses through the double-felted double tier dryer group, or from one such group to another.

While all straight, unsupported runs of a web or felt flutter to some degree, such flutter becomes undesirable when it has a high amplitude and low frequency, particularly in a long open draw, and particularly when the web is still quite wet. High amplitude, low frequency flutter causes the web to fold, crease, or break. Web flutter is speed dependent, and undesirable flutter occurs or increases at higher web speeds.

The web flutters as it passes through a long open draw because it is rapidly moving without support through the surrounding air and the surrounding air is turbulent. The amount of flutter depends on the length of the draw, the width of the paper web in the machine, the speed of the web passing through the machine, the basis weight of the web, the machine design, the permeability of the felt, and many other factors.

Flutter of a paper web can be compared to the snapping of a flag which is mounted on the antenna of a rapidly moving automobile, or which is exposed to a high wind as it flies on a flagpole. In the case of a modern paper machine, the web itself is moving at a speed greater than half a mile a minute in some instances.

A fluttering web is subject to frequent web breaks, which are expensive and time-consuming to correct. Even an occasional web break is a very big problem. It can damage the felt and even the machine, and it inevitably causes production of paper to stop until any necessary repairs can be made and the web can be re-threaded in the running machine.

While a web break is being corrected, a web of undried paper as wide as the machine (often about 30 feet or nine meters wide) and miles (several km.) long is formed and must be collected, broken up, mixed with a much larger quantity of water, and recycled in the paper machine. Machine speeds, and thus the amount of paper a machine could produce, were limited prior to the present invention by the need to avoid an excessive number of web breaks by keeping the web speed low enough to minimize its flutter in open draws. Even after taking this precaution, web breaks were a common occurrence.

An early attempt to minimize undesirable sheet flutter has been the use of a single-felted double tier or serpentine dryer group in place of one or more double-felted double tier groups. In a serpentine dryer group, the dryer cylinders are again arranged in two tiers, and the web path is the same, but the web and a single felt follow the same path between respective top and bottom cylinders. The serpentine configuration is illustrated by FIG. 2 of U.S. Pat. No. 4,202,113.

The serpentine configuration, although reducing the problem of undesirable sheet flutter, introduces several disadvantages. First, the heat transfer from the bottom dryer cylinders is substantially reduced because the wet web is not in direct contact with the bottom cylinders. The felt is interposed between the web and the drying surfaces of the bottom cylinders. Second, the web has a tendency to sag or otherwise separate from the felt because the web travels outside the felt as it wraps around the bottom cylinder. The web can thus be influenced by the moving air and gravity, and can separate from the felt to form a bubble or flutter. Third, the initial threading of the web is not particularly easy.

U.S. Pat. No. 4,359,827, issued to Thomas on Nov. 23, 1982, represents an attempt to solve the problems of the single-felted double tier dryer by, among other things, providing a comprehensive series of vacuum boxes and grooved dryer cylinders everywhere along the web run where the web is not captured between a felt and a dryer. The vacuum boxes and grooved rolls are intended to exert a normal force keeping the web on the felt at all points, both within a dryer group and in the transfers between dryer groups. The vacuum boxes, which are sometimes referred to herein as "restraining devices," greatly complicate the design of the dryer, prevent the removal of broke, require an extremely high vacuum system capacity, and tend to wear the felts out quickly. The Thomas design thus has never been used in a commercial machine.

In the BelRun top-felted series of single tier dryer groups sold by Beloit Corporation, the problems of the serpentine double tier design have been addressed to a large degree. BelRun is a registered trademark of Beloit Corporation. Single tier dryer groups may be top-felted (meaning that the bottom surface of the web contacts each dryer cylinder and the felt runs over the top of each dryer cylinder) or, less commonly, bottom-felted (meaning that the top surface of the web contacts each dryer cylinder and the felt runs under the bottom of the dryer cylinder).

In a BelRun group, particularly at the wet end of the dryer, the bottom, ineffective dryers of the serpentine double-tier machine are replaced by vacuum rolls disposed below and between each pair of the dryer cylinders of a top-felted single tier of dryer cylinders. The vacuum rolls are in close proximity to the adjacent dryer cylinders, and a felted run of the web passes from the preceding drying cylinder to the vacuum roll, and then to the next dryer cylinder.

The felted runs of a BelRun series of dryer groups are kept short to prevent the web from departing from the felt, and thus to eliminate or at least minimize flutter, when the web and felt pass from one roll to the next. Each vacuum roll draws the web against the felt as the felt traverses the vacuum roll to restrain the web against the felt. The felt tension directly holds the felt against the dryer cylinder. The single tier dryer group thus positively keeps the web and felt together as it conveys the web through the group.

Several top-felted single tier groups can be arranged in a series, with lick-down transfers between each group, so there is no open draw in the group to group transfer. A BelRun dryer section consisting of three single tier groups united by lick-down transfers is illustrated by FIG. 10 of Linderot, "Zehn Jahre Erfahrung mit Geschlossener Bahnfuhrung in der Trockenpartie," *Wochenblatt Fur Papierfabrikation,* August, 1986, page 623 at 628.

Recent installations of this type of dryer group have shown that the single tier concept can be extended to include a large number of dryers without any adverse effect on web runability. A single tier dryer section has good runability because the vacuum rolls are capable of conveying the web along the felt-supported spans and a lick-down transfer can transfer the web from one felt to the next without the need for sheet tension. In the prior art, sheet tension commonly is created by providing a substantial positive speed difference or "draw" between adjacent drying groups, typically a difference exceeding 10 feet (about 3 m.) per minute.

Each top-felted single tier dryer group in a BelRun dryer section principally dries the same side (the bottom) of the web. If the web is dried from one side only, the resulting dried paper may curl. "Curl", according to "Pulp and Paper Dictionary" by John R. Lavigne, published 1986, is "a paper or paper board deformation caused by non-uniform distribution of strains and stresses throughout the sheet as a result of uneven internal moisture and conditioning." Curl can be minimized or eliminated by drying the web from both sides, but two-sided drying requires a transfer point in which the web is transferred from the felt of a top-felted dryer or dryer group directly to another felt of a bottom-felted dryer or dryer group. This felt-to-felt transfer introduces substantial open draws unless further measures are taken to eliminate them.

An object of the present invention is to overcome the aforementioned inadequacies of the prior art apparatus and to provide a drying apparatus which contributes a significant and non-obvious contribution to the paper drying art.

Another object of the present invention is the provision of an apparatus for drying a web of paper which completely eliminates the need of extended open draws, at least in the wet end of the dryer section.

Another object of the present invention is the provision of an apparatus for drying a web of paper in which blow boxes and other restraining devices adjacent to the felted runs of the dryer section are unnecessary.

Another object of the present invention is the provision of an apparatus for drying a web of paper which permits automatic threading of a tail and subsequent web.

Another object of the present invention is the provision of an apparatus for drying a web in which open access to the dryers and vacuum rolls is provided.

Another object of the present invention is the provision of an apparatus for drying webs ranging from lightweight grades to heavy board.

Another object of the present invention is the provision of an apparatus for drying a web of paper in which the felt-supported draws are very short.

Another object of the present invention is the provision of an apparatus for drying a web of paper at a high speed substantially without flutter along the felted draws.

One or more of these objects, as well as other objects, features, and advantages of the present invention which will be apparent to those skilled in the art, are met by the present invention.

SUMMARY OF THE INVENTION

One aspect of the invention is a paper machine comprising a drying section including at least two dryer groups. One dryer group includes more than one drying cylinder and at least one vacuum roll. The drying cylinders have roll surfaces for contacting one major surface of a web. The axes of rotation of at least two consecutive drying cylinders lie substantially in a plane.

The vacuum roll has an axis of rotation disposed below the plane of dryer cylinders and a roll surface disposed in close proximity to the respective roll surfaces of two consecutive drying cylinders of the dryer group.

A second dryer group includes at least two other drying cylinders having roll surfaces for contacting the other major surface of a web. The axes of rotation of at least two consecutive drying cylinders of the second dryer group lie substantially in a further plane which is non-coplanar with the plane defined by the dryers of the first dryer group.

The vacuum roll of the second dryer group has an axis of rotation disposed above the further plane and a roll surface disposed in close proximity to the respective roll surfaces of the two consecutive dryer cylinders of the second dryer group. The plane and the further plane may be parallel in one embodiment of the invention, though non-parallel planes are also contemplated.

Another aspect of the invention is a dryer section for a paper machine or the like comprising first and second sequences of dryer cylinders, first and second sequences of vacuum rolls, and first and second felts.

The first sequence of dryer cylinders includes at least three consecutive, steam-heated dryer cylinders having axes of rotation disposed substantially in a first plane. The first sequence of vacuum rolls includes at least two non-steam-heated vacuum rolls, respectively for transferring a web from the first dryer cylinder to the second dryer cylinder and from the second dryer cylinder to the third dryer cylinder. The first and second vacuum rolls have axes of rotation disposed substantially in a second plane which is substantially parallel to but non-coplanar with the first plane.

The first felt successively wraps about the first dryer cylinder, the first vacuum roll, the second dryer cylinder, the second vacuum roll, and the third dryer cylinder for conveying a web from each dryer cylinder and each vacuum roll to the next element in sequence. The portion of the first felt running from the first dryer cylinder to the first vacuum roll and from the dryer cylinder to the second vacuum roll are leading runs of the felt. The portions of the first felt running from the first vacuum roll to the second dryer cylinder and from the second vacuum roll to the third dryer cylinder are following runs of the felt. The vacuum roll and dryer cylinder at the respective ends of each leading run are in close proximity.

The second sequence of dryer cylinders is similar to the first sequence of dryer cylinders, except that the axes of rotation of the second sequence of dryer cylinders are disposed substantially in a third plane. The second sequence of vacuum rolls is similar to the first sequence, except that the first and second vacuum rolls of the second sequence have axes of rotation disposed substantially in a fourth plane which is substantially parallel to but non-coplanar with the third plane. The second felt is entirely analogous to the first felt.

At least one of the third and fourth planes is non-coplanar with at least one of the first and second planes.

A third aspect of the invention is a paper machine for forming a web having top and bottom major surfaces, the machine comprising a drying section including as contiguous elements a top-felted dryer cylinder, a bottom-felted vacuum roll, a top-felted vacuum roll, and a bottom-felted dryer cylinder.

A top felt is wound over the top-felted dryer cylinder for holding the bottom major surface of the web against the top-felted dryer cylinder, under the bottom-felted vacuum roll, and passes in proximity to the top-felted vacuum roll. The top felt has a straight run at least between the bottom-felted vacuum roll and the top-felted vacuum roll.

A bottom felt passes in proximity to the bottom-felted vacuum roll, is wound over the top-felted vacuum roll, and is wound under the bottom-felted dryer cylinder for holding the top major surface of the web against the bottom-felted dryer cylinder. The bottom felt has a straight run at least between the bottom-felted vacuum roll and the top-felted vacuum roll.

The straight runs of the top felt and the bottom felt come into proximity to define a joint run where the web is conveyed from one of the top felt and the bottom felt to the other.

Still another aspect of the invention is a single tier dryer for drying a web including a dryer cylinder, a further dryer cylinder, a felt, a further felt, and a dryer transfer. The felt is guided about the dryer cylinder for supporting a web between the dryer cylinder and the felt for drying a first side of the web. The further dryer cylinder is disposed downstream relative to the dryer cylinder. The further felt is guided about the further dryer cylinder for supporting a web between the further dryer cylinder and the further felt for drying a second side of the web.

The dryer transfer transfers the web from the dryer cylinder to the further dryer cylinder, and includes a joint run of the felt and the further felt and a vacuum roll. The joint run receives the web between the felt and the further felt when the web passes through the joint run. The vacuum roll is disposed at the downstream end of the joint run for positively maintaining the web in close conformity with the further felt when the felt and further felt diverge downstream from the joint run. The felt and the further felt are free from restraining devices as they pass through the joint run.

Still another aspect of the invention is a method for drying a web. At least one dryer cylinder, at least one further dryer cylinder disposed downstream relative to the dryer cylinder, a felt having a web-receiving surface and a back surface, a further felt having a web-receiving surface and a back surface, and a vacuum roll are provided.

The felt is guided about the dryer cylinder for receiving a web between the dryer cylinder and the web-receiving surface of the felt for drying a first side of the web. A straight run of the felt is positioned downstream of the dryer cylinder so the web-receiving surface of the felt faces substantially downstream relative to the back surface of the felt. A run of the further felt is located substantially downstream of the straight run of the felt. The web-receiving surfaces of the straight run of the felt and the run of the further felt face and are in proximity to define a joint run for receiving the web between the felt and the further felt.

The back surface of the downstream portion of the run of the further felt is wrapped about a vacuum roll, causing the further felt to diverge from the felt downstream of the joint run. The web is transferred from the straight run of the felt to the run of the further felt. A vacuum is drawn into the vacuum roll for positively maintaining the web in close conformity with the further felt when the felt and further felt diverge. The further felt is then wrapped about the further dryer cylinder for receiving the web between the further dryer cylinder and the further felt for drying a second side of the web.

The felt and the further felt are kept free from restraining devices during the passage of the felt and the further felt through the joint run.

BRIEF DESCRIPTION OF THE DRAWINGS

Similar or identical reference characters refer to similar parts throughout the various embodiments of the present invention.

Definitions

As used herein, the term "single tier" or "single tier drying group" refers to a drying group in which at least two sequential dryers are arranged in one tier or row, with a vacuum roll between and in close proximity to each two dryers and the felt passing alternately about the dryer cylinders and vacuum rolls. While conventionally all the dryer cylinders of a single tier drying group are in a single plane and all the vacuum rolls of the same group are in another single plane, it is not necessary that all the dryer cylinders or all the vacuum rolls of a group be in one plane, or that the planes of the dryer cylinders or vacuum rolls be horizontal.

As used herein, the term "joint run of the felts" means a geometry in which the felts of successive dryer groups are brought into close proximity to each other, and travel in at least approximately the same direction, so a web can be transferred from one felt to the other felt while minimizing web flutter. The joint run need not be a parallel run of the felts, and the felts defining the joint run do not necessarily touch, either directly or by being separated only by the thickness of the web.

As used herein, "close proximity" refers to the distances between the roll surfaces of a dryer cylinder and adjacent vacuum roll of a single tier dryer group, measured along lines connecting their axes of rotation. A dryer cylinder and vacuum roll are in close proximity if they are close enough that the felt draw between each of the vacuum rolls and their corresponding dryers is minimal (in the sense of very small, as opposed to the absolute minimum) in light of the conditions of machine construction and operation, thereby reducing or substantially eliminating web flutter relative to the supporting felt running between the dryer cylinder and vacuum roll, or vice versa. Specific, non-limiting examples of "close proximity" are given later in this specification. A person skilled in the art is well aware of the need to provide close proximity and of the range of spacing for given running conditions which satisfies this need.

As used herein, the term "extended open draw" refers to a machine configured to carry an length of web which is unsupported by a felt or other structure on either side for at least about eight inches (200 mm), typically at least about 16 inches (400 mm), measured along the running web in the machine direction.

DETAILED DESCRIPTION OF THE INVENTION

Although this detailed description and the accompanying drawings describe preferred embodiments of the present invention, it should be appreciated by those skilled in the art that many variations and modifications of the present invention fall within the spirit and scope of the present invention as defined by the appended claims. The present claims are not limited to the embodiments specifically illustrated in the specification and drawings, which are merely exemplary.

Figure 1:
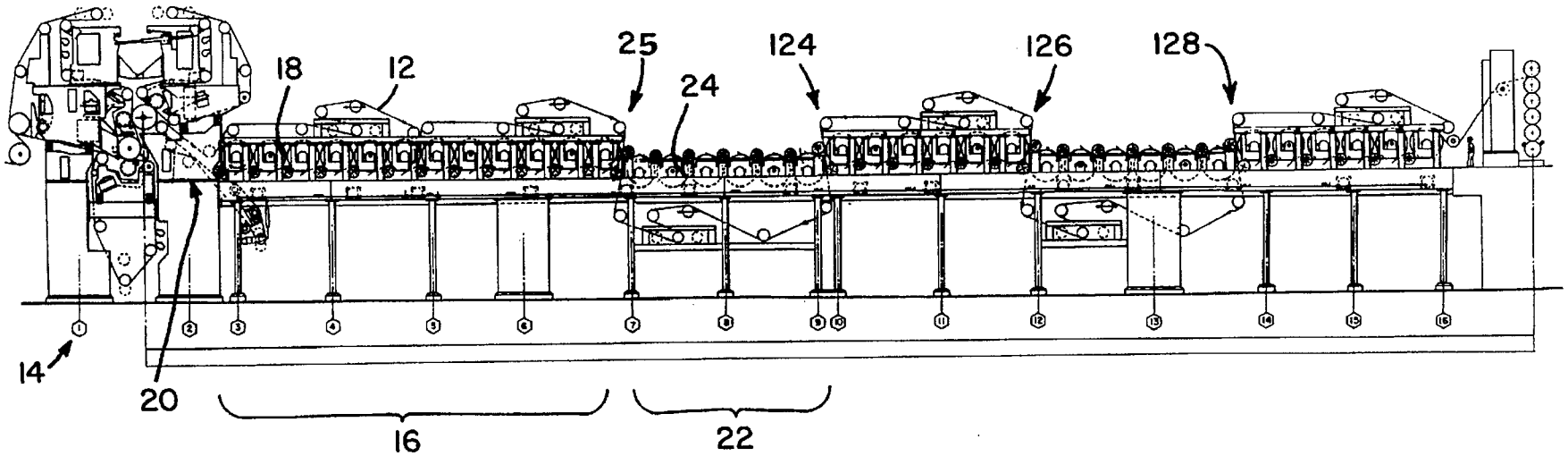
FIG. 1 is a side elevational view of the dryer section of a papermaking machine according to the present invention, also showing the press section and the calender respectively preceding and following the dryer section.

The paper machine partially illustrated in FIG. 1 comprises a forming section in which a pulp slurry is turned into a sheet, a press section which squeezes the web to begin the de-watering process, a drying section or dryer in which the web is de-watered to essentially its final dryness, and a reel on which the sheet is wound at the end of the machine. Other sections sometimes found in paper machines include a calender to smooth the sheet surface, a size press and after-dryer to add sizing to the sheet, a coater, and other equipment. The web formed on the machine has top and bottom major surfaces.

Dryer Arrangement

Figure 2:
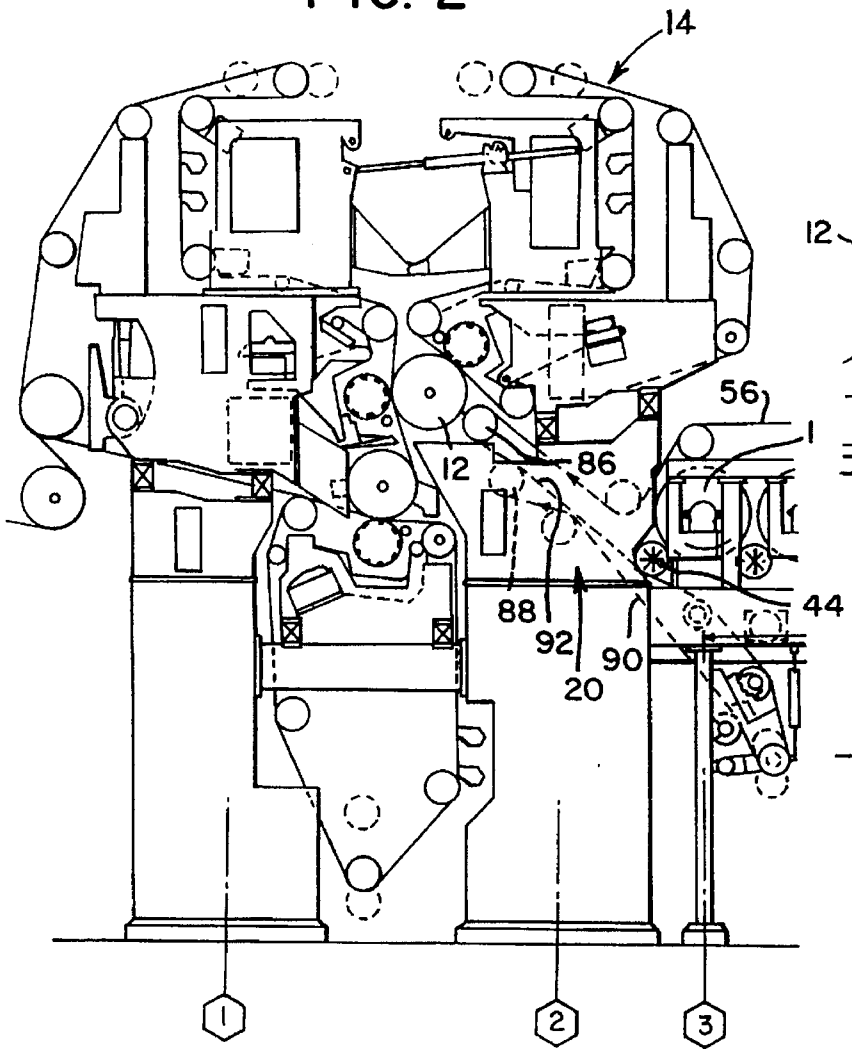
FIG. 2 is an enlarged fragmentary view of FIG. 1 showing the press section and the mechanism for transferring the web from the press section to the first dryer group.
Figure 3:
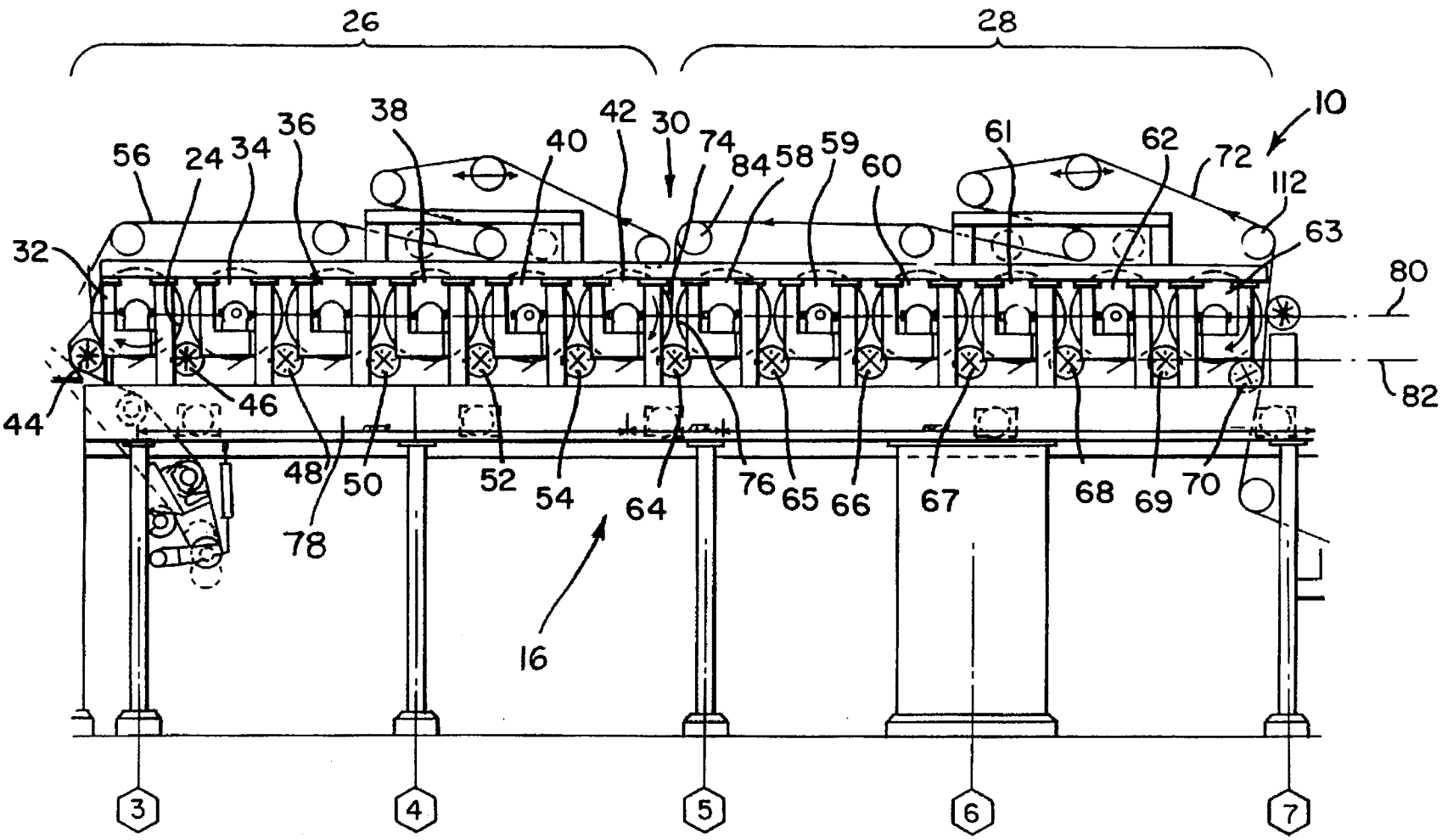
FIG. 3 is an enlarged fragmentary view of FIG. 1 showing two successive top-felted dryer groups which are the first two dryer groups in the dryer section.
Figure 6:
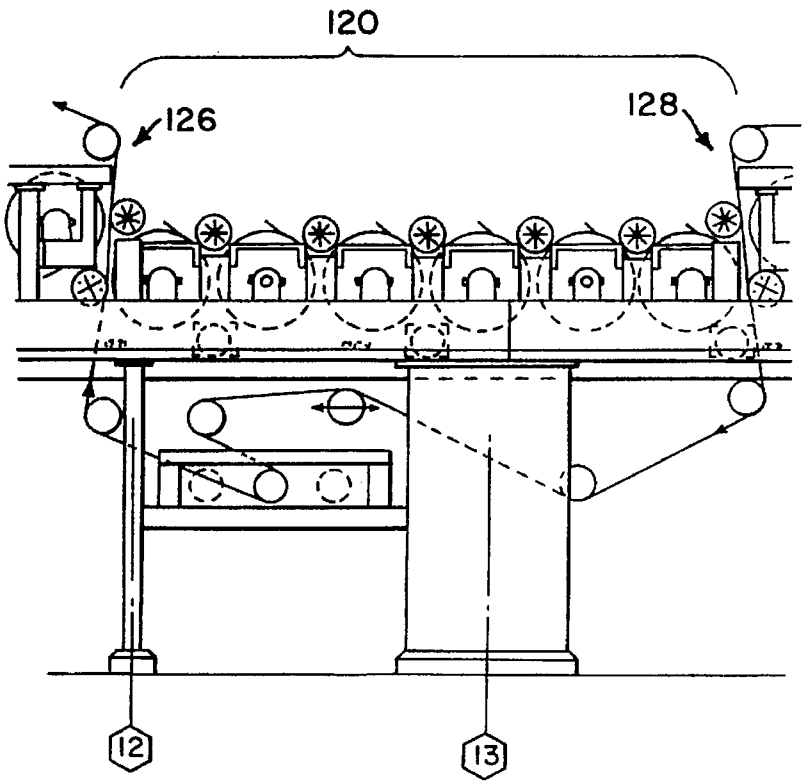
FIG. 6 is an enlarged fragmentary view of FIG. 1 showing the fifth dryer group, which is bottom-felted.

Referring to FIGS. 1, 2, and 3, the dryer generally designated 10 is used for drying a web 12 of paper emerging from a press section, generally designated 14, of a papermaking machine. (FIGS. 2 through 7, positioned side by side, together form an enlarged view of FIG. 1.) A web transfer, generally designated 20, transfers the web 12 from the press section 14 to the first group 26 of a series of top-felted dryer groups, generally designated 16, for initiating the drying of a first side 18 of the web 12.

Figure 4:
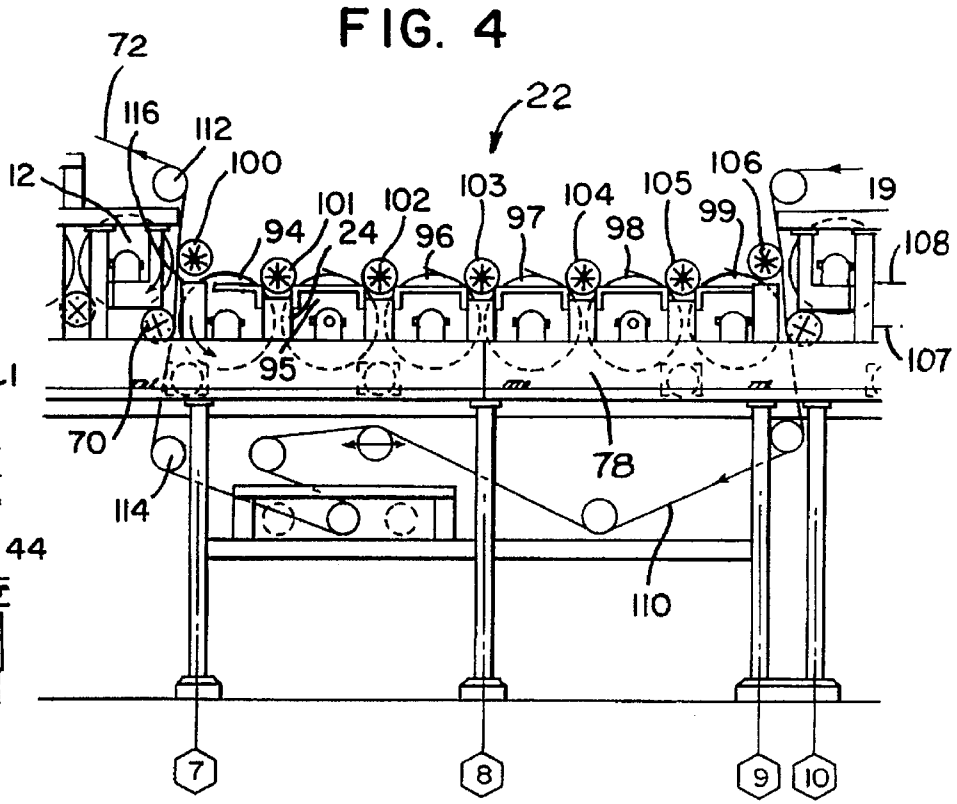
FIG. 4 is an enlarged fragmentary view of FIG. 1 showing the third dryer group—a bottom-felted group.

Referring now to FIGS. 1, 3, and 4, a dryer transfer, generally designated 25, transfers the web 12 without an extended open draw between the last top-felted dryer group 28 of the series 16 and the first bottom-felted dryer group 22. The dryer transfer 25 permits both threading of the web 12 without the assistance of threading ropes and the drying of both sides 18 and 24 of the web 12. The bottom-felted dryer group 22 initiates the drying of a second side 24 of the web 12 which is opposite to the first side 18 thereof.

Referring now to FIGS. 1 through 7, the dryer 10 further includes a top-felted dryer group 118, a bottom-felted dryer group 120, and a top-felted dryer group 122, which function similarly to the prior sections and include similar transfers.

The invention is described in more detail, with reference to FIGS. 1 through 18 like those in this specification, in U.S. Pat. No. 5,144,758, issued to the present inventors on Sep. 8, 1992, from column 12, line 15 to column 20, line 28, which is incorporated by reference above. The following description emphasizes several specific aspects of the present invention.

Plane Arrangement of Dryer Groups

The dryer group 28 of FIG. 3 includes more than one steam-heated drying cylinder, in particular the drying cylinders 58, 59, 60, 61, 62, and 63. The axes of rotation of at least two consecutive drying cylinders such as 62 and 63, and here the axes of all the drying cylinders of the group 28, lie substantially in a plane.

The group 28 includes at least one non-steam-heated vacuum roll, and here includes the vacuum rolls 64, 65, 66, 67, 68, 69, and 70. At least the vacuum roll 69, and here all the vacuum rolls 64 through 70, have axes of rotation disposed in a plane 82 substantially parallel to but non-coplanar with and below the plane 80 of the dryer cylinders. The vacuum rolls such as 69 transfer a web in a felted draw extending from the preceding dryer cylinder such as 62 to the following dryer cylinder such as 63.

A felt successively wraps about the dryer cylinder 61, the vacuum roll 68, the dryer cylinder 62, the vacuum roll 69, and the dryer cylinder 63 for conveying a web from each dryer cylinder or vacuum roll to the next element in sequence. The portion of the felt running from the dryer cylinder 61 to the vacuum roll 68 and from the dryer cylinder 62 to the vacuum roll 69 are leading runs of the felt. The portions of the felt running from the vacuum roll 68 to the dryer cylinder 62 and from the vacuum roll 69 to the dryer cylinder 63 are following runs of the felt. The vacuum roll such as 68 and dryer cylinder such as 61 at the respective ends of each leading run are in close proximity. The vacuum roll such as 68 and dryer cylinder such as 62 at the respective ends of each following run are also in close proximity.

Figure 8:
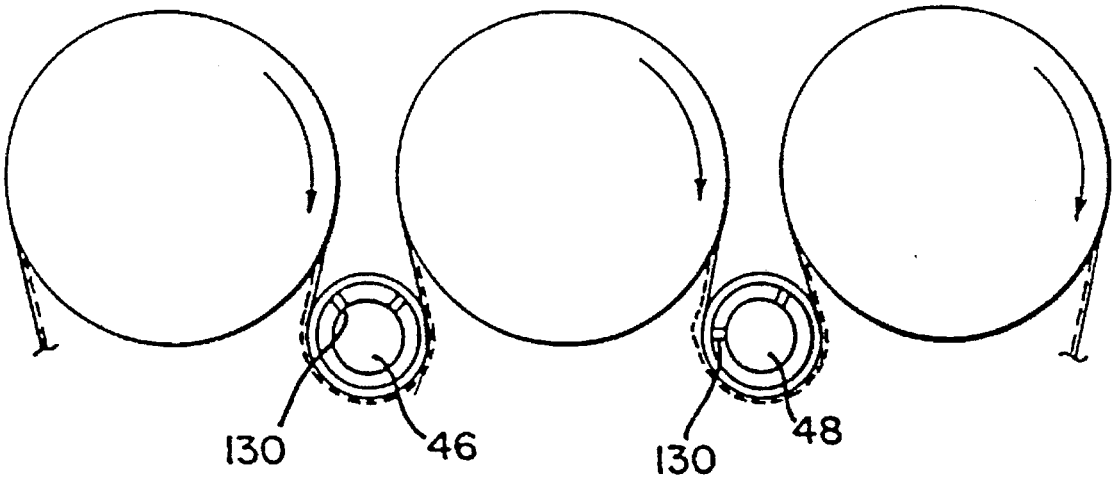
FIG. 8 is a diagrammatic side elevational view of the present invention showing three vacuum rolls within one dryer group.
Figure 11:
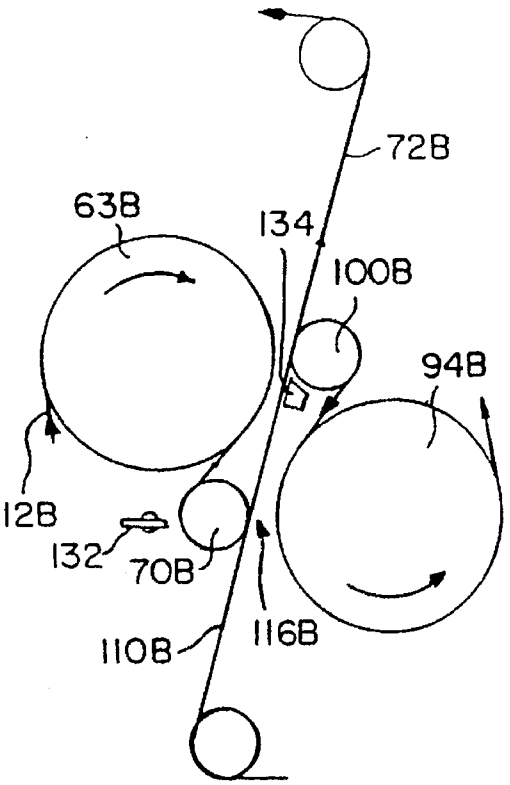
FIG. 11 is a side elevational view of another embodiment of the dryer group to dryer group transfer of the present invention.

The leading runs and the following runs can have different lengths and still represent "close proximity", for at least two reasons. Refer briefly to FIGS. 3 and 8, which correspond because they have identically numbered vacuum rolls 46 and 48 and corresponding dryer cylinders 32, 34, and 36.

The first reason for this result is that leading runs of the felt and following runs of the felt operate in different boundary air environments. In FIGS. 3 and 8, the portion of the felt between the dryer cylinder 32 and the vacuum roll 46 is a leading run and is approaching the vacuum roll 46. The clockwise rotating surface of the dryer cylinder 32 and the counterclockwise rotating surface of the vacuum roll 46 each direct boundary air from the pocket between the dryers 32 and 34 toward the air nozzle 136. Since the felt 56 is permeable, some of this air is directed to the left through the felt 56, tending to separate the less-permeable sheet (shown in dotted lines) from the felt 56. The closer together the cylinder 32 and the vacuum roll 46 are placed, the less boundary air is pumped through the space between them, and the less tendency the web has to part from the web in this region. Thus, leading felt runs must be quite short to counteract blowing of the web from the felt by boundary air.

The run going from the roll 46 to the dryer cylinder 34 is a following run and is leaving the vacuum roll 46. The clockwise rotating surface of the dryer cylinder 34 and the counterclockwise rotating surface of the vacuum roll 46 each direct boundary air from the area beneath the dryer cylinder 34 toward the pocket between the dryers 32 and 34. Since the felt 56 is permeable, some of this air is directed to the left through the felt 56, tending to urge the less-permeable sheet (shown in dotted lines) against the felt 56. Thus, boundary air tends to hold the web against the felt along a following run of the felt.

Because flutter is inhibited by boundary air in a following run and encouraged by boundary air in a leading run, the vacuum roll and dryer cylinder defining a following run can be further apart without departing from the requirement of substantially eliminating flutter than the vacuum roll and dryer cylinder defining a leading run of the felt can be. Thus, the vacuum rolls such as 46 can be asymmetrically placed between the dryer cylinders such as 32 and 34, and the leading and following runs associated with the same vacuum roll can each be in close proximity.

The second reason why the leading and following runs in close proximity can be differently spaced is that there is a range of tolerable spacings which are small enough to at least substantially eliminate flutter. The specific endpoints of this range depend on many factors, and so universally applicable numerical ranges cannot be stated. But exemplary spacings proposed for the dryer cylinder and vacuum roll (measured along a line connecting the centers of the rolls) for leading and following runs of the web vary from as little as 1/16 inch (about 1.5 mm) or less, or alternately about 0.2 inch (5 mm) or less, particularly if the vacuum roll 46 has a flexible mount so it can be deflected by a passing wad without damage, to 5 inches (125 mm) or more.

If the separation between the rolls is too great under the circumstances, the web may depart from the felt as they pass between the vacuum roll and the dryer cylinder. The lower limit of separation is proposed because if the separation between the rolls is too small, the paper machine could be damaged. One source of possible damage is "broke"—waste paper produced by remnants of a web which has broken, and which can wrap about the dryer cylinders after a web break. Another source of possible damage is a wad of paper (built up by fibers accumulating on a machine part and falling onto the web surface) being carried by the felt into the gap between the dryer cylinder and the vacuum roll. These numerical limits are only representative, however, and do not distinguish the present invention from the prior art.

A roll separation greater than the minimum possible separation is also contemplated if auxiliary blowing equipment (like the air nozzle 136 in FIG. 8) is used, a heavy basis weight sheet is formed, a less permeable felt is employed, a relatively low running speed is contemplated, it is desired to keep the rolls far enough apart to allow access between them or to avoid crushing a human hand or limb accidently extended between the operating rolls, the dryer gearing or framework placement requires a certain separation of the rolls, or some other special situation exists.

A modest speed machine (typically running at less than 3000 feet or 914 meters per minute) running a web which is to become light weight coated paper has successfully been run with its rolls defining leading runs about one inch (more precisely, about 35 mm) apart and its rolls defining following runs about three inches (more precisely, about 80 mm) apart.

All this information, as well as considerable operating and design experience with different roll spacings, has been available to persons of ordinary skill in the art since before the present invention was made. One of ordinary skill in the art is able to design a system in which the vacuum rolls and dryer cylinders are in close proximity, whether the rolls defining leading and following runs are equally spaced or differently spaced, without undue experimentation.

The drying cylinders such as 63 have roll surfaces for contacting one major surface, here, the lower surface, of a web 12. The vacuum rolls such as 69 have roll surfaces disposed in close proximity to the respective roll surfaces of two consecutive drying cylinders such as 62 and 63 of the dryer group. The vacuum rolls 64 through 68 are similarly situated respecting the adjacent dryer cylinders in this embodiment.

A bottom-felted dryer group 22, shown best in FIG. 4, includes at least two drying cylinders such as 94 and 95. The drying cylinders 94 and 95 (as well as 96, 97, 98, and 99, in this embodiment) have roll surfaces for contacting the other (upper) major surface of a web. The axes of rotation of at least two consecutive drying cylinders of the dryer group 22, such as the dryer cylinders 94 and 95, lie substantially in a further plane which is non-coplanar with the plane defined by the dryers such as 12 (visible in FIG. 4, denoted as 63 in FIG. 3) and 58 of the dryer group 28 shown in FIG. 3. The plane of dryers in the group 28 and the further plane of dryers in the group 22 are parallel in this embodiment of the invention, though non-parallel planes are also contemplated.

At least one vacuum roll such as 101 of the dryer group 22 (and here, the rolls 102, 103, 104, and 105 as well) has an axis of rotation disposed above the further plane defined by the rolls 94 and 95 and a roll surface disposed in close proximity to the respective roll surfaces of the two consecutive members 94 and 95 of the dryer group 22.

The second sequence of dryer cylinders such as 94, 95, and 96 in the dryer group 22 of FIG. 4 is similar to the first sequence such as 61, 62, and 63 of FIG. 3, except that the dryer cylinders rotate in the opposite direction, the dryers are bottom-felted, and the axes of rotation of the second sequence of dryer cylinders are disposed substantially in a third plane which is non-coplanar with the plane of the dryer cylinders 61, 62, and 63. The second sequence of vacuum rolls such as 101 and 102 is similar to the first sequence, except that the first and second vacuum rolls of the second sequence have axes of rotation disposed substantially in a fourth plane which is substantially parallel to but non-coplanar with the third plane. The second felt is entirely analogous to the first felt.

At least one of the third and fourth planes is non-coplanar with at least one of the first and second planes. Though in this embodiment all the planes are parallel, respective sections could rise and fall, so the first and third planes would be skewed, within the scope of the present invention. This expedient might be taken to shorten the drying section of a machine, particularly if it is lengthy and web breaks requiring ready access to the dryers seldom occur.

In an alternate embodiment of the invention, the centers of the dryer cylinders in consecutive top-felted and bottom-felted sections could be coplanar, with the vacuum rolls of the respective sections on opposite sides of the plane of the dryer cylinders. In still another embodiment of the invention, the centers of the dryer cylinders in one top-felted group could be coplanar with the vacuum rolls of the adjacent dryer group, and vice versa. These alternate embodiments are within the scope of the present invention.

Dryer Transfers

The machine illustrated in the Figures has two types of dryer-to-dryer transfers: a lick-down or non-web-reversing transfer 30, best illustrated in FIG. 3, and several web-reversing transfers 25, 116, 116A, 116B, 124, 126, and 128 shown best in FIGS. 3 through 7 and 9 through 12. The distinction between these two types of transfers is that a non-web-reversing transfer transfers the web from one felt to a dryer, then directly from the dryer to the second felt. The same side of the web contacts the felts before and after the transfer, so the same side of the web contacts the dryers in each case. In a web-reversing transfer, the web is transferred directly from one felt to the next. The opposite sides of the web contact the felts before and after the transfer, so the opposite side of the web contacts the dryers after the transfer.

Figure 5:
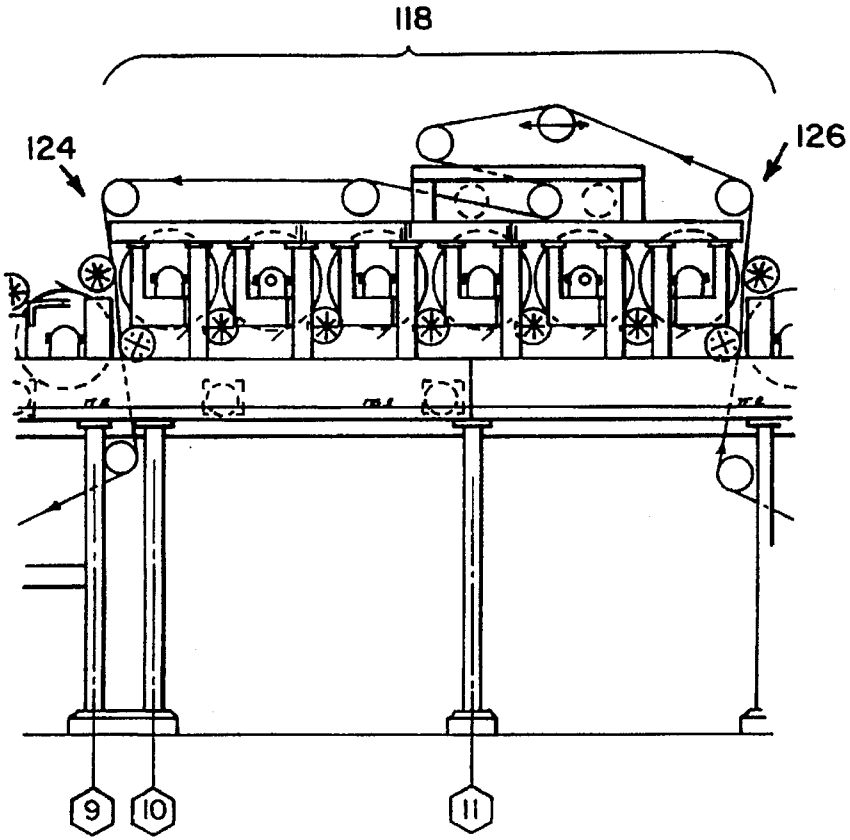
FIG. 5 is an enlarged fragmentary view of FIG. 1 showing the fourth dryer group, which is top-felted.
Figure 7:
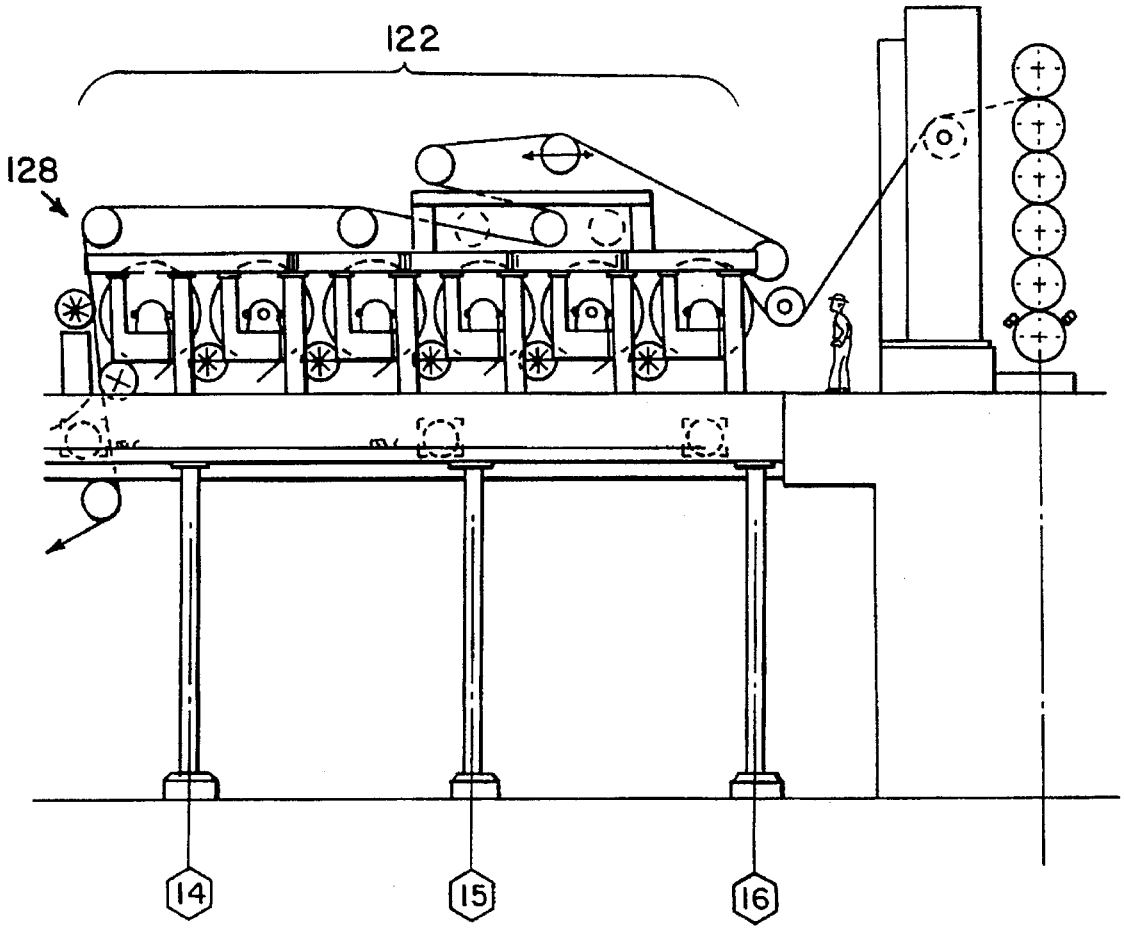
FIG. 7 is an enlarged fragmentary view of FIG. 1 showing the sixth dryer section, which is top-felted.

Each web-reversing dryer group transfer extends from a top-felted section to a bottom-felted section (such as the transfer 25 between groups 28 and 22 shown in FIGS. 3 and 4) or vice versa (such as the transfer between groups 22 and 118 shown in FIGS. 4 and 5). The transfer 25 includes as contiguous elements a top-felted dryer cylinder 63 (12 in FIG. 4), a bottom-felted vacuum roll 70, a top-felted vacuum roll 100, and a bottom-felted dryer cylinder 94. A top felt 72 is wound over the top-felted dryer cylinder 63 for holding the bottom major surface of the web 12 against the top-felted dryer cylinder 63, under the bottom-felted vacuum roll 70, and passes in proximity to the top-felted vacuum roll 100.

In the embodiment of FIGS. 1 through 9 (best seen in FIG. 9), the top felt 72 appears to be separated from the top-felted vacuum roll 100 only by the thickness of the felt 110. The parallel felts 72 and 110 are not necessarily in contact or separated only by the thickness of the web, however; greater separations of parallel felts are contemplated herein. (Since the web is only a few thousandths of an inch or hundredths of a millimeter thick, the felts are about ⅛ inch (3 mm) thick, and the dryers are on the order of six feet (1.8 meters) or more in diameter, patent drawings are necessarily out of scale respecting the separation of two nearby felts.) Similarly, the bottom felt 110 and the bottom-felted vacuum roll 70 of FIG. 9 may either be separated by only the thickness of the web and the felt 72 or further apart within the scope of the invention.

Figure 10:
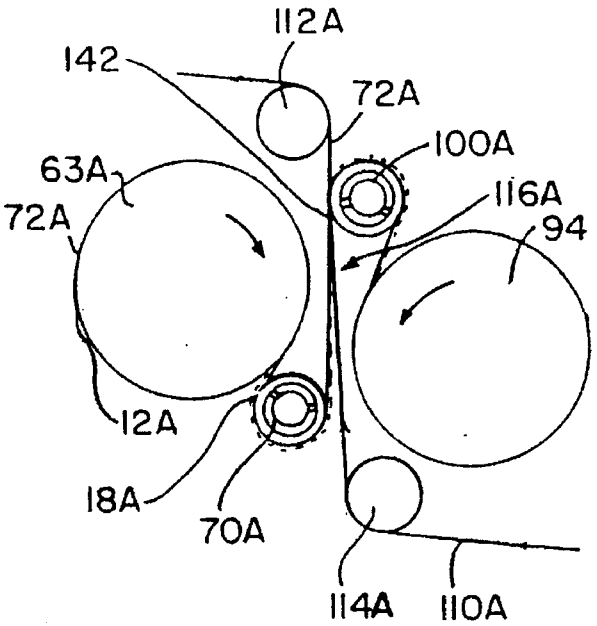
FIG. 10 is a side elevational view of a further embodiment of the dryer group to dryer group transfer of the present invention.

In the embodiment of FIG. 10, the bottom felt 110A and the vacuum roll 70A are shown further apart than the thickness of the felt and the web disposed between them. The bottom felt 110A and the vacuum roll 70A are still considered here to be in proximity, particularly since boundary air carried into the converging joint run between the felts 72A and 110A tends to urge the web 12A (shown as a dashed line in the transfer area) into contact with the felt 72A and prevent flutter or other problems in the joint run.

Figure 9:
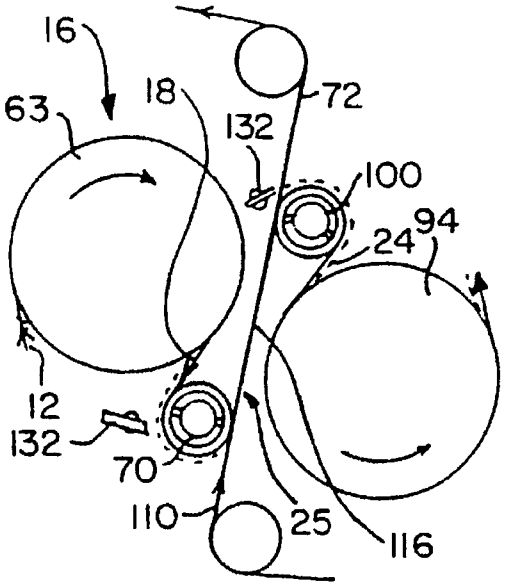
FIG. 9 is a side elevational view of one embodiment of the dryer group to dryer group transfer of the present invention.

Returning to FIG. 9, the top felt 72 has a straight run at least between the bottom-felted vacuum roll 70 and the top-felted vacuum roll 100. In the embodiment of FIG. 9, the straight run extends above the vacuum roll 100 and on to the next felt roll 112. In an alternate embodiment of the invention, the top felt 72 can be wrapped about the vacuum roll 100, thus ending the straight run at the vacuum roll 100. The contemplated degree of wrap is very slight—20 degrees or less, alternately 10 degrees or less. The bottom felt 110 passes in proximity to the bottom-felted vacuum roll 70, is wound over the top-felted vacuum roll 100, and is wound under the bottom-felted dryer cylinder 94 for holding the top surface of the web 12 against the bottom-felted dryer cylinder 94. The bottom felt 110 has a straight run at least between the bottom-felted vacuum roll 70 and the top-felted vacuum roll. In this instance, the straight run of the bottom felt 110 extends all the way from the preceding felt roll 114 to the top-felted vacuum roll 100. In an alternate embodiment of the invention, the bottom felt 110 could be wrapped about the vacuum roll 70, thus causing the straight run to begin where the bottom felt 110 is wrapped about the vacuum roll 70. The contemplated degree of wrap is very slight—20 degrees or less, alternately 10 degrees or less.

The straight runs of the top felt 72 and the bottom felt 110 come into proximity to define a joint run 116 where the web is conveyed from one of the top felt 72 and the bottom felt 110 to the other, and here from the former to the latter. A transfer from the bottom felt 110 to the top felt 72 is also illustrated by the apparatus of FIG. 9, assuming the directions of rotation of the dryer cylinders 63 and 94, the vacuum rolls 70 and 100, and all other elements of the dryer group were reversed and the felts and web consequently ran in the opposite direction.

Referring to FIG. 10, an analogous transfer is shown, except that the felts 72A and 110A converge in the joint run 116A. The contemplated angle of convergence ranges from a small negative angle (i.e. slightly diverging felts at the transfer) of less than −5 degrees to about zero degrees (the parallel felts illustrated in FIG. 9), to a positive angle of less than about 30 degrees, alternately less than about 20 degrees. The maximum angles of convergence and divergence contemplated herein are those which allow the web or tail to transfer from one felt to the next successfully and substantially without web flutter.

Figure 12:
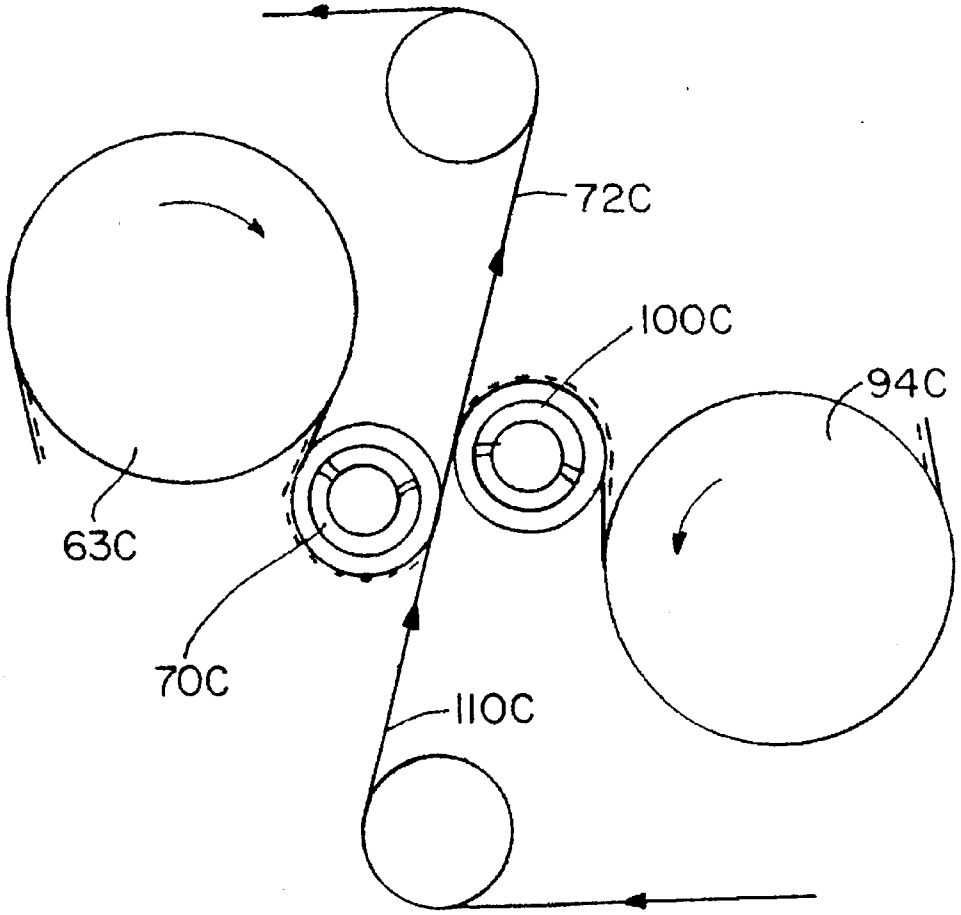
FIG. 12 is a side elevational view of a further embodiment of the dryer group to dryer group transfer of the present invention.
Figure 13:
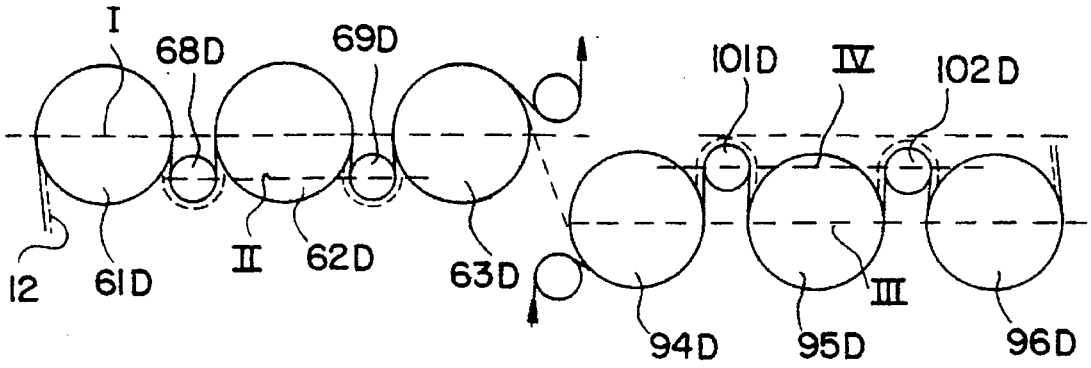
FIG. 13 is a diagrammatic representation of an arrangement of two successive dryer groups according to the present invention.
Figure 14:
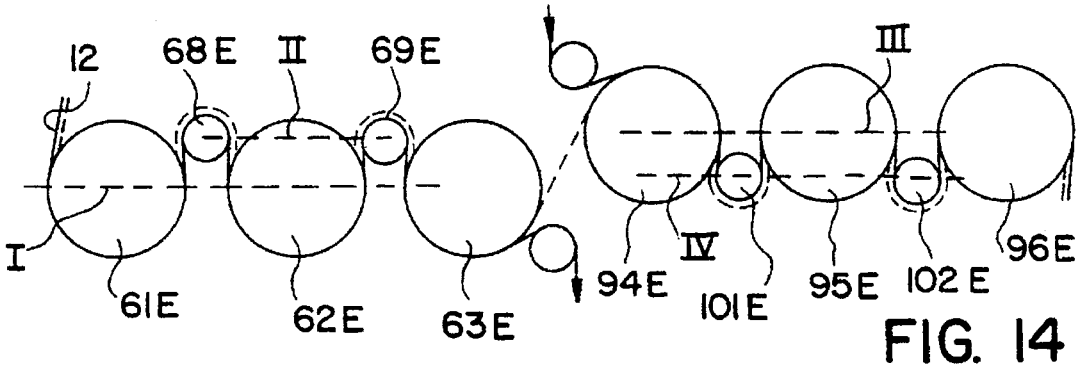
FIGS. 14 through 18 are views similar to FIG. 13 of other arrangements of two successive dryer groups according to the present invention.
Figure 15:
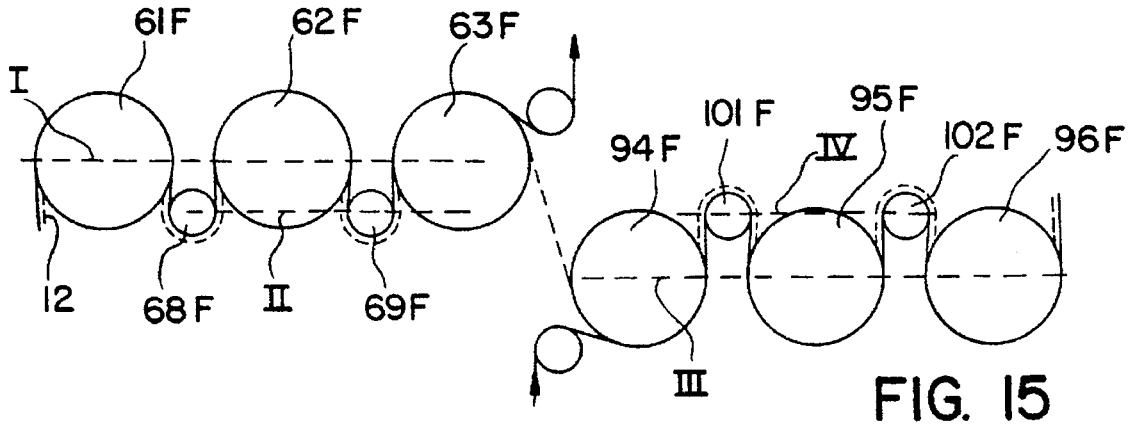
Figure 16:
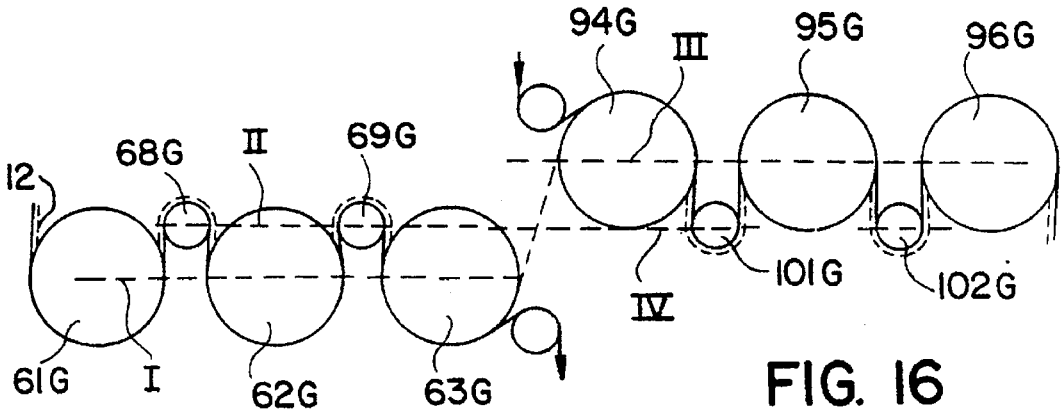
Figure 17:
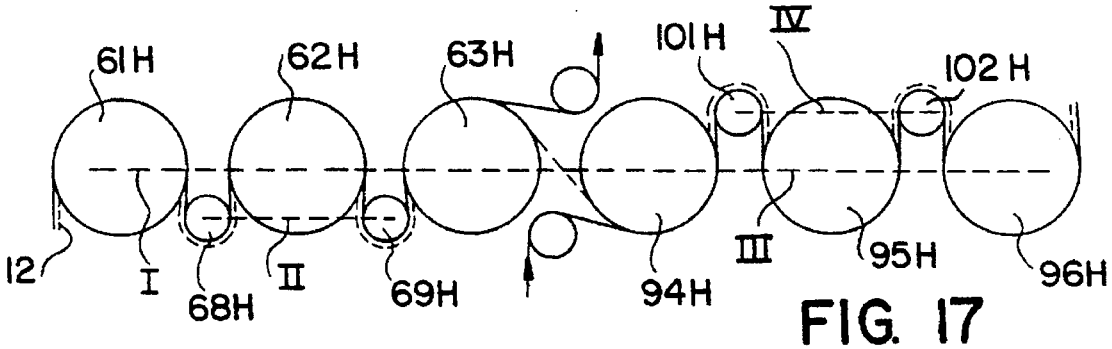
Figure 18:
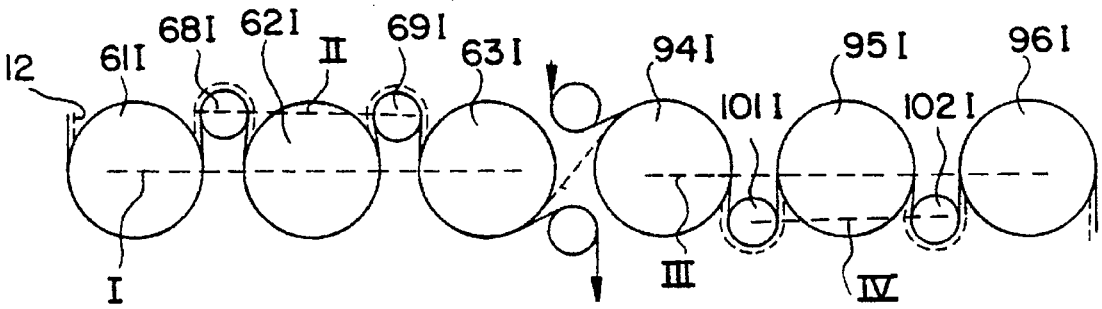

The maximum acceptable angle of divergence depends on the length of the joint run between the vacuum rolls 70A and 100A; the longer the joint run is, the smaller the maximum angle can be to leave the felts 72A and 110A in sufficiently close proximity at the vacuum roll 100A to successfully transfer the web or tail. Referring briefly to FIG. 12, if the vacuum rolls for the transfer are very close together, the joint run of the webs is quite short, and a fairly large angle between the felts would result in only a small space between one or the other of the vacuum rolls 70C and 100C and the outside felt. (The felt 110C is the outside felt in relation to the felt roll 70C, and the felt 72C is the outside felt in relation to the vacuum roll 100C).

The angle of divergence also depends on the absolute and relative speeds of the felts 72A and 110A. If a small positive speed difference or speed draw is maintained between the felts, for example, the web can be made to transfer before it reaches the vacuum roll 100A, so the web transfer is not influenced directly by the distance between the felt 72A and the vacuum roll 100A.

Perhaps the biggest factor in a diverging transfer which minimizes the acceptable angle of divergence is the need to be able to transfer a tail from one felt to the next when threading the dryer section. The leading end of the tail cannot be drawn by a downstream vacuum roll as a running web can be; it needs to be able to jump or be pushed from one felt to the other, instead of being pulled. The angle of divergence must be small for the tail to transfer, but it could be increased after the tail was threaded and the web was running. A larger angle of divergence is also possible if threading aids, such as threading nozzles or (less desirably) ropes are provided.

Different factors determine the maximum acceptable converging angle between the felts. In a converging transfer, the felts 72A and 110A are closest at the downstream vacuum roll which can draw the web or tail across the gap, if any, between the felts. The vacuum drawn by the vacuum roll 100A can assist in transferring the tail of the web even if the felts 72A and 110A never come as close together as the thickness of the web they are intended to carry.

The vacuum roll 100A can exert a pulling force on a tail or other portion of the web which is a slight distance away from the portion of the felt 110A wrapping the vacuum roll 100A—for example, about an inch (25 mm) to the left of the felt 110A at the vacuum levels preferred herein (4 inches (100 mm) water column or more). Air nozzles, blow boxes, vacuum boxes, or other stationary apparatus can also be used to assist the transfer of the web by the vacuum roll 100A. However, any such devices used in the transfer preferably are positioned sufficiently far from each felt that no stationary parts of a device are usually or even occasionally contacted by the felt, even when the felt is displaced by a wad or a wad passes between the device and the felt. Any such stationary devices which have the potential for felt contact are called "restraining devices" herein. The felt and the further felt are preferably free from restraining devices as they pass through the joint run.

The running web can also be transferred in the joint run at a point upstream of the vacuum roll 100A, and thus outside of its direct influence, after the machine has been threaded, again by establishing a slight positive speed draw between the felts 72A and 110A. If the running web is to be transferred upstream of the vacuum roll 100A, the felts 72A and 110A should be disposed at a relatively small angle, such as about 20 degrees or less, alternatively about 15 degrees or less, so the point of transfer can be shifted upstream without creating an extended open draw and so the merging streams of boundary air carried into the joint run by the respective felts will not become turbulent in the joint run and promote web flutter.

Other factors which enter into the selection of an angle between the felts 72A and 110A are the weight and constitution of the paper to be made on the machine, the water content of the web at a given transfer, the speed of the machine, the diameters of the dryer cylinders and vacuum rolls, and so forth.

Still another aspect of the invention is a method for drying a web. The method is carried out by providing a dryer section arranged as described herein in relation to FIGS. 1 through 12, passing a web through the dryer section, and thus drying both sides of the web.

The transfers and single tier dryer groups arranged according to the present invention are not necessarily used at or near the dry end of the machine. Instead, another type of transfer, such as a conventional transfer allowing a substantial open draw, can be used once the web is sufficiently dry and strong that it can flutter to a considerable degree without breaking or being damaged. The level of sheet restraint which is provided can also be reduced near the dry end of the machine, as by reducing or even eliminating the vacuum drawn by the vacuum rolls (or changing the last vacuum rolls to ordinary felt rolls which only draw vacuum in the areas which carry the tail to thread the web, and only during threading). A double-felted double tier dryer may also be used at the dry end of the machine.

These expedients, and particularly the use of a double tier dryer section at the dry end, allow the dry end of the machine to be shorter, reduce the vacuum capacity requirement of the drying section, accommodate the substantial shrinkage which commonly occurs in the dry end of the machine without damaging the web, and allow curl to be prevented or remedied by controlling the respective steam pressures in the upper and lower dryer cylinders.

Because the present invention is particularly valuable in the wet end of the machine, machines which employ at least one transfer according to the present invention or at least one top-felted section and one bottom-felted section (consecutively, in either order) according to the present invention, are within the scope of the present invention, even though other parts of the same machine may have different construction.

The present invention provides a drying section which is capable of operating at extremely high speeds as no extended open draw is necessary, particularly in the wet end of the dryer section. Furthermore, the present invention enables threading of the drying section without the use of threading ropes. Additionally, the web is dried while being restrained against machine and cross-machine directional shrinkage, particularly in the wet end, thereby reducing curl and improving the cross-machine direction profile and other properties of the resulting web.

What is claimed is:

1. A dryer section comprising:

A. a first sequence of at least first, second, and third consecutive, steam-heated dryer cylinders having axes of rotation disposed substantially in a first plane;

B. first and second non-steam-heated vacuum rolls, respectively for transferring a web from said first dryer cylinder to said second dryer cylinder and from said second dryer cylinder to said third dryer cylinder, said first and second vacuum rolls having axes of rotation disposed substantially in a second plane which is substantially parallel to but non-coplanar with said first plane;

C. a first felt successively wrapping about said first dryer cylinder, said first vacuum roll, said second dryer cylinder, said second vacuum roll, and said third dryer cylinder for conveying a web from each dryer cylinder and each vacuum roll to the next element in sequence, the portion of said first felt running from said first dryer cylinder to said first vacuum roll and the portion of said first felt running from said dryer cylinder to said second vacuum roll defining leading runs of said felt, and the portion of said first felt running from said first vacuum roll to said second dryer cylinder and the portion of said first felt running from said second vacuum roll to said third dryer cylinder defining following runs of said felt, wherein the vacuum roll and dryer cylinder at the respective ends of each said leading run are in close proximity;

D. a second sequence of at least fourth, fifth, and sixth consecutive, steam-heated dryer cylinders having axes of rotation disposed substantially in a third plane; and E. third and fourth non-steam-heated vacuum rolls, respectively for transferring a web from said fourth dryer cylinder to said fifth dryer cylinder and for transferring a web from said fifth dryer cylinder to said sixth dryer cylinder, said third and fourth vacuum rolls having axes of rotation disposed substantially in a fourth plane which is substantially parallel to but non-coplanar with said third plane;

F. a second felt successively wrapping about said fourth dryer cylinder, said third vacuum roll, said fifth dryer cylinder, said fourth vacuum roll, and said sixth dryer cylinder for conveying a web from each dryer cylinder and each vacuum roll to the next element in sequence, the portion of said second felt running from said fourth dryer cylinder to said third vacuum roll and the portion of said second felt running from said fifth dryer cylinder to said fourth vacuum roll defining leading runs of said second felt, and the portion of said second felt running from said third vacuum roll to said fifth dryer cylinder and the portion of said second felt running from said fourth vacuum roll to said sixth dryer cylinder defining following runs of said second felt, wherein the vacuum roll and dryer cylinder at the respective ends of each leading run are in close proximity;

wherein at least one of said third and fourth planes is non-coplanar with at least one of said first and second planes.

* * * * *